United States Patent [19]

Rothbard

[11] Patent Number: 4,877,241

[45] Date of Patent: Oct. 31, 1989

[54] BASKETBALL HOOP AND NET APPARATUS

[76] Inventor: Robert Rothbard, 4900 Laurel, Bellaire, Tex. 77401

[21] Appl. No.: 129,184

[22] Filed: Dec. 7, 1987

[51] Int. Cl.[4] ..... A63B 63/08

[52] U.S. Cl. ..... 273/1.5 R

[58] Field of Search ..... 273/1.5 RA; D21/201

[56] References Cited

U.S. PATENT DOCUMENTS

| | | | |
|---|---|---|---|
| Re. 15,739 | 1/1924 | Jackson, Jr. | 273/1.5 R |
| 2,199,609 | 5/1940 | Bennett | 273/1.5 R |

OTHER PUBLICATIONS

Jamison Mfg. Co. Catalog, 2-1966, #369-822 net.
Mexico Force Catalog, 6-1984, p. 68.
Recreation Sports & Leisure, 9-1987, Double Steel Ring.
Quality Industries, Inc. Catalog, No. 983, 3-1983, p. 60.
J. E. Burke Co. Catalog, 2-1975, p. 21.

*Primary Examiner*—Paul E. Shapiro
*Attorney, Agent, or Firm*—Kenneth A. Roddy

[57] ABSTRACT

A basketball hoop and net apparatus comprises a circular metal rim with a coaxial continuous circular net supporting ring secured to the underside thereof. The net supporting ring has a plurality of circumferentially spaced semicircular depending loops about its periphery. A mounting bracket is secured to the outer periphery of the rim and ring members to mount the hoop to a backboard. The net assemby is formed of a series of separate elongate generally vertical linking members in the form of separate lengths of chain or separate elongate rod members having an eye portion at their top and bottom ends with the eyes at the top ends each slidably received and movably captured on the depending loops of the net supporting ring and the eyes at the bottom ends each movably connected by a circular bottom connecting ring in generally vertical circumferentially spaced relation to allow a basketball to slide therethrough. The elongate vertical chain or rod members may also be connected at their midpoints by an intermediate continuous connecting ring. Alternatively, the rod members are connected in an upper and lower series in alternating circumferentially spaced relation. The lengths of chain or rod members may aso be provided with a protective sleeve of weather resistive material.

14 Claims, 2 Drawing Sheets

BASKETBALL HOOP AND NET APPARATUS

BACKGROUND OF THE INVENTION

1. FIELD OF THE INVENTION

This invention relates generally to a basketball hoop and, more particularly, to a basketball hoop and net apparatus incorporating a weather resistant net and attachment apparatus.

2. DESCRIPTION OF THE PRIOR ART

Various types of basketball hoops and nets have been tried and are in use today. However, the most common type of hoop in use on schools, colleges and in professional competitive sports comprises a metal hoop having an inside diameter of eighteen inches, from which is suspended a fabric cord netting and to which there is secured a typical mounting bracket so as to be readily mounted to what is generally referred to as a "back board".

A plurality of metal wire loop members are affixed, generally by welding, to depend downwardly from the under annular portion of the hoop member. Each wire loop member is bent back on itself, providing a hook to allow the upper looped strands of the net to be individually and removably supported over the formed hooks.

During game play there is a tendency for the looped strands to become disengaged from the hooks, causing delay in the game proceedings while the disconnected net is being fixed. In addition, the continuous movement of the net causes the supporting strands to wear since the net is freely attached to the rim hooks.

Another more serious problem occurs when a player is reaching for the ball or making a shot at the basket rim. When a player has jumped from the playing floor and has his arms, hands, and fingers stretched upwardly, a finger or a ring can be caught in the looped support wire, possibly causing great bodily harm.

Also, because of the greater height of the present-day athlete, a player's head can be brought into contact with the underside of the metal basket rim while he is jumping for the ball under the net. There is also a problem when a player wears a long ornamental neck chain. This, too, has caused serious injury to players with the well known basketball hoop presently in use.

Outdoor basketball goals typically use the above described hoop construction and utilize nylon nets, chain nets, or no nets at all. The nylon nets become torn due to the continuous exposure to the deteriorating effects of sun and rain. Nets made of chain are attached to the depending wire loops or hooks by an "S" link member. The link attachment easily becomes bent out of shape and detached due to pulling on the net. Both types of outdoor nets present the same hazards to the player as described above.

There are several patents which disclose various basketball hoop and net constructions.

Hill, U.S. Pat. No. 4,082,269 discloses a protective basketball hoop having a plastic net supporting member fixedly circumfused substantially about the rim. The plastic member supporting the net is an integrally formed, depending, annular rib member, or members. The rib is formed as a continuous circumferential rib or a plurality of equally spaced rib members having the upper cords of conventional net material molded therein.

Palm, U.S. Pat. No. 4,241,916 discloses a basketball hoop having a plurality of "no-tie" fasteners, or hooks, attached to the rim underside and receive the cord loops of the net material. The hooks of the Palm device present the same hazards as conventional hoops described above.

The present invention is distinguished over the prior art and these patents in particular by a basketball hoop and net apparatus having a circular metal rim and a coaxial continuous circular ring secured to the underside thereof for attaching and supporting the net therebetween. The lower circular ring has a plurality of circumferentially spaced semicircular depending loops about its periphery which receive the upper link of a chain net or the eye of a rod member forming a part of the net. When the rim and ring members are secured together as by welding, the top chain links or eyes of the rods are movably captured between the two members within the loops. The chain or rod portions of the net may be surrounded by a weather resistive sleeve or provided with a weather resistive coating.

SUMMARY OF THE INVENTION

It is therefore an object of the invention to provide a basketball hoop and net apparatus which has the basketball netting formed as an integral part thereof so as to prevent any disconnection of the net during game play or by vandalism.

Another object of the invention is to provide a basketball hoop and net apparatus suitable for outdoor use which is weather resistant to extend the useful life of its components.

Another object of the invention is to provide a basketball hoop and net apparatus that complies with all the requirements under college and professional game regulations.

It is a further object of the invention to provide a basketball hoop and net apparatus that does not require service, or replacement.

A further object of the invention is to provide a net of metallic construction to eliminate the wear of cord net loops caused by constant movement of the nets.

A still further object of the invention is to provide a basketball hoop and net apparatus which is simple in design, economical to manufacture, and rugged and durable in use.

Other objects of the invention will become apparent from time to time throughout the specification and claims as hereinafter related.

The above noted objects and other objects of the invention are accomplished by a basketball hoop and net apparatus having a circular metal rim and a coaxial continuous circular ring secured to the underside thereof for attaching and supporting the net therebetween. The lower circular ring has a plurality of circumferentially spaced semicircular depending loops about its periphery which receive the upper link of a chain net or the eye of a rod member forming a part of the net. When the rim and ring members are secured together as by welding, the top chain links or eyes of the rods are movably captured between the two members within the loops. The chain or rod portions of the net may be surrounded by a weather resistive sleeve or provided with a weather resistive coating.

DESCRIPTION OF THE PREFERRED EMBODIMENT

Figure 1:
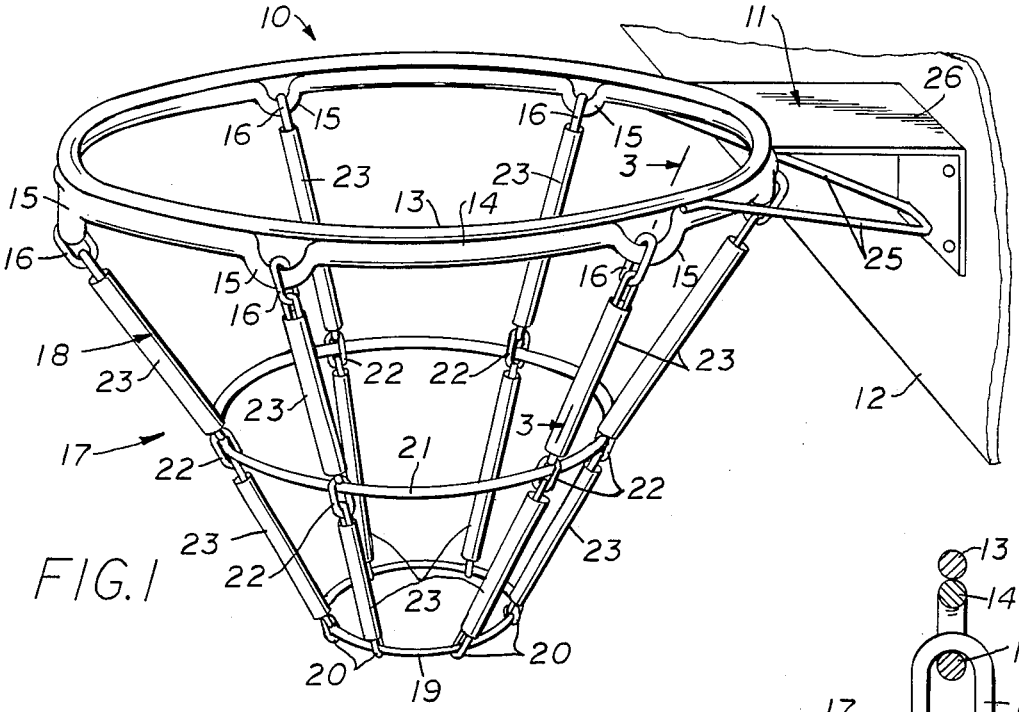
FIG. 1 is a perspective view of the basketball hoop and net apparatus showing it mounted in the well known manner to a back board.

Referring more particularly to FIG. 1, there is shown a basketball hoop and net apparatus generally indicated at 10, having a standard type mounting bracket designated at 11, the bracket being secured to any well known type of back board 12, whether it be made of wood, steel, fiberglass, or clear glasslike material.

The hoop and net apparatus 10 comprises a circular rim 13 having a circular lower net-supporting ring 14 secured to the underside of the annular rim 13 coaxial therewith. The netsupport ring 14 comprises a continuous circular member having a round cross section and a plurality of integrally formed circumferentially spaced, semicircular depending curves or loops 15 which receive the top links 16 of a chain net 17.

The chain net 17 of the apparatus comprises a series of lengths of metal chain 18 each having their top link 16 slidably received on one loop 15 of the net-supporting ring 14. A lower circular ring 19 smaller in diameter than the supporting ring 14 is slidably received through each of the lower links 20 of the chain 18 to movably connect the lower ends of the chains together in a generally vertical circumferentially spaced relation. An intermediate circular ring 21 smaller in diameter than the supporting ring 14, but larger in diameter than the lower ring 19 is slidably received through the links 22 of the chain 18 intermediate the top and bottom links 16 and 19 to movably connect the mid-portions of the chains together in circumferentially spaced relation.

Figure 3:
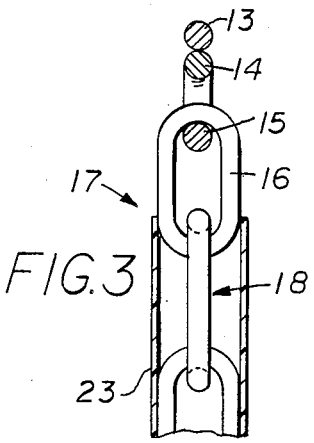
FIG. 3 is a cross section view taken along line 3-3 of FIG. 1 showing a section of a chain net suspended from the circular ring member.
Figure 2:
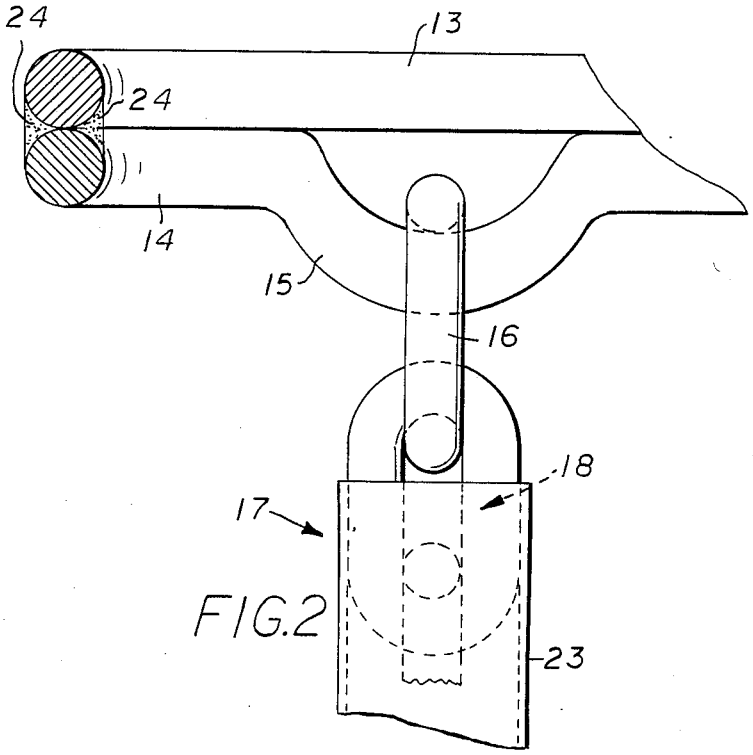
FIG. 2 is an enlarged, fragmentary, side elevation thereof.

As shown in FIGS. 1 through 3, a tubular protective sleeve 23 surrounds each length of chain leaving only a small portion of the top, bottom, and intermediate links 16, 19, and 22 of the chains 18 exposed. The protective sleeves 23 are formed of suitable weather resistive material, such as rubber or plastic. A heat shrink material may also be used. It should also be understood, that the lengths of chain may be sprayed or dipped to provide a weather resistive coating.

After the top links 16 of the chains 18 have been inserted onto the loops 15 of the support ring 14, the rim 13 and net supporting ring 14 are secured together by welding as indicated by 24 to provide a single strong unit to which the mounting bracket is secured. The mounting bracket 11 is secured to the joined metal circular rim 13 and supporting ring 14 by welding the side supporting frame struts 25 of the bracket 11 between the bent bracket plate 26 and the circumferential juncture of the rim 13 and ring 14.

Figure 5:
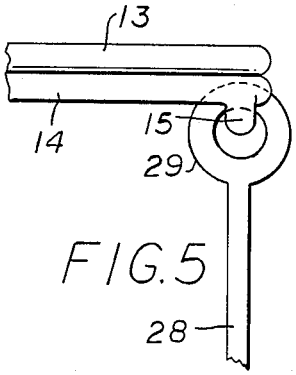
FIG. 5 is a partial elevation showing the rod member of the alternative net construction of FIG. 4.
Figure 4:
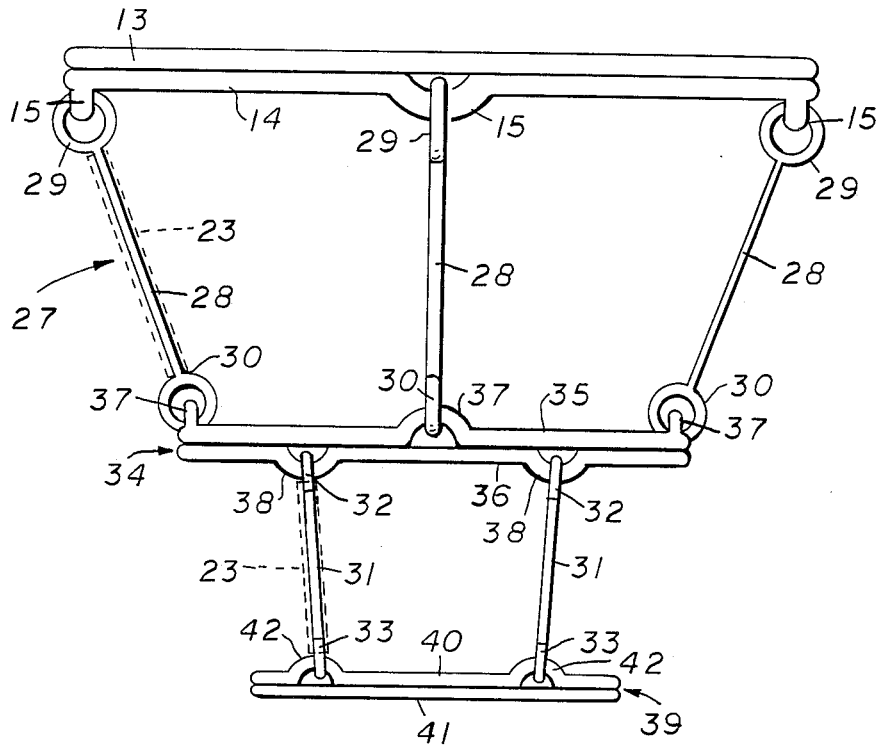
FIG. 4 is a side elevation of a modified basketball hoop and net apparatus having an alternative net construction.

Alternatively, as shown in FIGS. 4 and 5, the net 27 of the apparatus may be formed of an upper set of metal rods 28 having a circular eye at their top end 29 and bottom end 3 and a lower set of metal rods 31 each having a circular eye at their top end 32 and bottom end 33. The eyes 29 at the top ends of the upper rods 28 are slidably received each on one loop 15 of the net-supporting ring 14 and the eyes 30 at the bottom ends of the rods 28 are received in an intermediate double ring assembly 34 which is smaller in diameter than the supporting ring 14.

The intermediate double ring assembly 34 comprises an upper circular ring 35 and a lower circular ring 36 secured thereto coaxial therewith. The rings 35 and 36 are continuous circular members having a round cross section and a plurality of integrally formed circumferentially spaced, semicircular curves or loops 37 and 38 respectively. The rings 35 and 36 are secured together in opposed relation by welding or other suitable means such that the loops 37 on the upper ring 35 face upwardly and the loops 38 on the lower ring 36 face downwardly in generally vertical alternately spaced relation about the circumference of the ring assembly.

The eyes 32 at the top ends of the lower set of rods 31 are slidably received on the downwardly facing loops 38 of the ring 36 and the eyes at the bottom ends of the lower rods 31 are received in a bottom double ring assembly 39 which is smaller in diameter than the intermediate ring assembly 34. The bottom double ring assembly 39 comprises an upper circular ring 40 and a lower circular ring 41 secured thereto coaxial therewith. The rings 40 and 41 are continuous circular members having a round cross section and upper ring 40 has a plurality of integrally formed circumferentially spaced, semicircular curves or loops 42. The rings 40 and 41 are secured together by welding or other suitable means such that the loops 42 on the upper ring 40 face upwardly and slidably receive the bottom eyes 33 of the lower set of rods 31.

It should be understood that the eyes 33 at the bottom of the lower rods 31 are slidably received on loops 42 of the ring 40 prior to the rings 40 and 41 being secured together, the eyes 32 at the top of rods 31 are slidably received on loops 38 of ring 36 and the eyes 30 at the bottom of rods 28 are slidably received on the loops 37 prior to the rings 35 and 36 being secured together. The ends of the ring members may also be welded together after the eyes are installed thereon to form continuous rings. In this manner, the top and bottom ends of the rod members are movably connected in generally vertical circumferentially spaced relation and configured to allow a basketball to slide therethrough.

After the top links 16 of the chains 18 or top eyes 29 of the rods 28 have been inserted onto the loops 15 of the support ring 14, the rim 13 and net supporting ring 14 are secured together by welding as indicated by 24 to provide a single strong unit to which the mounting bracket 11 is secured. The mounting bracket 11 is secured to the joined metal circular rim 13 and supporting ring 14 by welding the side supporting frame struts 25 of the bracket 11 between the bent bracket plate 26 and the circumferential juncture of the rim 13 and ring 14.

Figure 6:
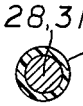
FIG. 6 is a transverse cross section view showing a rod member having a weather resistive protective coating.

As previously described with reference to the chain net assembly 17, the rods 28 and 31 may also be provided with a tubular sleeve 23 of suitable weather resistive material to surround substantially their length leaving only a small portion of the eyes exposed as indicated by dotted line in FIG. 4. A heat shrink material may also be used as a sleeve. As shown in FIG. 6, the rods 28 and 31 may also be sprayed or dipped to provide a weather resistive coating 44.

After the eyes of the rods have been inserted onto the loops of the appropriate rings and the ring members secured together by welding, the mounting bracket is secured to the joined metal circular rim 13 and supporting ring 14 by welding the side supporting frame struts between the bent bracket plate and the rim and ring assembly, as shown and described previously with reference to FIG. 1.

In this manner, the top links of the chain net or the eyes of the rods are permanently captured between the rim and the net-supporting ring or the intermediate and bottom ring assemblies to form a movable integral part of the basketball hoop so as to prevent any disconnection of the net during game play or by vandalism. All elements of the basketball hoop are smooth and rounded to prevent accidental injury to a player. The rugged construction of the basketball hoop and net components and weather resistive sleeves or coating makes the present invention particularly suitable for outdoor use.

The preferred hoop and net apparatus would be constructed to meet the requirements for regulation basketball equipment. For example, the annular ring rim 13 would have an inside diameter of eighteen inches and the bottom ring 19 or ring assembly 39 would be of sufficient diameter to allow the regulation basketball to slide therethrough.

While this invention has been described fully and completely with special emphasis upon several preferred embodiments, it should be understood that within the scope of the appended claims the invention may be practiced otherwise than as specifically described herein.

I claim:

1. A basketball hoop and net apparatus comprising;

a circular rim member, a continuous circular net supporting ring member secured to the underside of said rim member and coaxial therewith and having a plurality of integrally formed circumferentially spaced semicircular depending loops about its periphery, a mounting bracket secured to the outer periphery of said rim member and said ring member for mounting said hoop to a backboard, a net assembly comprising a series of separate elongate rod members each having an eye at their top and bottom ends, a continuous circular bottom ring smaller in diameter than said rim member secured to the bottom ends of said net assembly rod members, the eyes at the top ends of said rod members slidably received each on one loop of said net supporting ring and movably captured between said rim and said net supporting ring when secured together and the eyes at the bottom ends of said rod members each movably connected by said circular bottom ring in generally vertical circumferentially spaced relation to allow a basketball to side therethrough.

2. A basketball hoop and net apparatus according to claim 1 including a protective sleeve of weather resistive material surrounding each said rod member leaving only a small portion of the top, and bottom eyes of said rod members exposed.

3. A basketball hoop and net apparatus according to claim 1 in which said series of rods comprise;

an upper series of rod members having an eye at their top and bottom ends, a lower series of rod members having an eye at their top and bottom ends, the eyes at the top ends of said upper rod members slidably received each on one loop of said net supporting ring and movably captured between said rim and said rim when secured together and the eyes at the bottom ends of said upper rods movably connected by intermediate connecting means in circumferentially spaced relation, the eyes at the top ends of said lower rod members movably connected between the eyes at the bottom ends of said upper rods by connecting means in alternating circumferentially spaced relation, and the eyes at the bottom ends of said lower rod members movably connected by connecting means in circumferentially spaced relation.

4. A basketball hoop and net apparatus according to claim 3 in which said connecting means for movably connecting the eyes at the bottom of said upper rods and the eyes at the top of said lower rods comprises an intermediate ring assembly which is smaller in diameter than said net supporting ring, said connecting means for movably connecting the eyes at the bottom of said lower rods comprises a bottom ring assembly which is smaller in diameter than said intermediate ring assembly and of sufficient diameter to allow a basketball to slide therethrough.

5. A basketball hoop and net apparatus according to claim 4 in which said intermediate ring assembly comprises;

an upper circular ring member having a round cross section and a plurality of integrally formed circumferentially spaced semicircular loops, a lower circular ring member coaxial therewith and secured thereto and having a round cross section and a plurality of integrally formed circumferentially spaced semicircular loops, said upper and lower ring members secured together in opposed relation such that the loops on said upper ring face upwardly and the loops on said lower ring face downwardly in alternately spaced relation about the circumference of said intermediate ring assembly, and the eyes at the bottom ends of said upper rods are slidably received one in each upwardly facing loop and the eyes at the top ends of said lower rods slidably received one in each downwardly facing loops of said intermediate ring assembly.

6. A basketball hoop and net apparatus according to claim 4 in which said bottom ring assembly comprises;

an upper circular ring member having a round cross section and a plurality of integrally formed circumferentially spaced semicircular loops, a lower circular ring member coaxial therewith and secured thereto, said upper and lower ring members secured together in superposed relation such that the loops on said upper ring face upwardly, and the eyes at the bottom ends of said lower rods are slidably received one in each upwardly facing loop.

7. A basketball hoop and net apparatus according to claim 1 including a protective coating of weather resistive material on each said rod.

8. A basketball net for attachment to a basketball hoop comprising;

a series of separate elongate lengths of chain formed of weather resistant material each having their top link adapted to be slidably received on the basketball hoop and supported therefrom in generally vertical circumferentially spaced relation, a continuous circular bottom connecting ring received through each of the bottom links of each said chain to movably connect the lower ends of said chains together in circumferentially spaced relation in a generally vertical configuration to allow a basketball to slide therethrough, and a protective sleeve of weather resistive material substantially surrounding each length of chain leaving only a small portion of the top and bottom links of said chains exposed.

9. A basketball net according to claim 8 including;

a continuous circular intermediate connecting ring smaller in diameter than said hoop and larger in diameter than said bottom ring slidably received through the links of said chains intermediate the top and bottom links to movably connect the midportions of said chains together in generally vertical circumferentially spaced relation.

10. A basketball net for attachment to a basketball hoop of the type having net mounting loops, the net comprising;

a series of separate elongate rod members each having an eye at their top and bottom ends, a continuous circular bottom ring having a round cross section and a plurality of integrally formed circumferentially spaced semicircular loops and of smaller diameter then the basketball hoop secured to the bottom ends of said rod members, the eyes at the top ends of said rod members each adapted to be received and movably captured on a mounting loop of a basketball hoop and the eyes at the bottom ends of said rod members each received one in each semicircular loop of said continuous circular bottom ring in generally vertical circumferentially spaced relation to allow a basketball to slide therethrough.

11. A basketball net according to claim 10 in which said series of rods comprise;

an upper series of rod members having an eye at their top and bottom ends, a lower series of rod members having an eye at their top and bottom ends, the eyes at the top ends of said upper rod members each adapted to be received and movably captured on a mounting loop of a basketball hoop and the eyes at the bottom ends of said upper rods movably connected in generally vertical circumferentially spaced relation by an intermediate continuous circular connecting ring which is smaller in diameter than the basketball hoop, the eyes at the top ends of said lower rod members movably connected between the eyes at the bottom ends of said upper rods by said intermediate ring in alternating generally vertical circumferentially spaced relation, and the eyes at the bottom ends of said lower rod members movably connected by connecting means in generally vertical circumferentially spaced relation by a continuous circular bottom ring which is smaller in diameter than said intermediate ring and of sufficient diameter to allow a basketball to slide therethrough.

12. A basketball net according to claim 11 in which said intermediate ring assembly comprises;

an upper circular ring member having a round cross section and a plurality of integrally formed circumferentially spaced semicircular loops, a lower circular ring member coaxial therewith and secured thereto and having a round cross section and a plurality of integrally formed circumferentially spaced semicircular loops, said upper and lower ring members secured together in opposed relation such that the loops on said upper ring face upwardly and the loops on said lower ring face downwardly in alternately spaced relation about the circumference of said intermediate ring assembly, and the eyes at the bottom ends of said upper rods are slidably received one in each upwardly facing loop and the eyes at the top ends of said lower rods slidably received one in each downwardly facing loops of said intermediate ring assembly.

13. A basketball net according to claim 11 including a protective sleeve of weather resistive material surrounding each said upper and lower rod leaving only a small portion of the eyes at each end thereof exposed.

14. A basketball net according to claim 11 in which said bottom ring assembly comprises;

an upper circular ring member having a round cross section and a plurality of integrally formed circumferentially spaced semicircular loops, a lower circular ring member coaxial therewith and secured thereto, said upper and lower ring members secured together in superposed relation such that he loops on said upper ring face upwardly, and the eyes at the bottom ends of said lower rods are slidably received one in each upwardly facing loop.

* * * * *